United States Patent [19]

Borgwarth

[11] Patent Number: 4,898,071

[45] Date of Patent: Feb. 6, 1990

[54] INFLATABLE AMMUNITION GRIPPING DEVICE

[75] Inventor: Dennis Borgwarth, Anoka, Minn.

[73] Assignee: FMC Corporation, Chicago, Ill.

[21] Appl. No.: 248,055

[22] Filed: Sep. 23, 1988

[51] Int. Cl.[4] ..... E41F 9/08

[52] U.S. Cl. ..... 89/45; 414/676

[58] Field of Search ..... 89/1.801, 1.805, 33.03, 89/34, 45, 46; 414/676

[56] References Cited

U.S. PATENT DOCUMENTS

| | | | |
|---|---|---|---|
| 3,072,022 | 1/1963 | Wood et al. | 89/1.806 |
| 3,252,589 | 5/1966 | Keene et al. | 414/676 |
| 3,513,934 | 5/1970 | Crowley | 414/676 |
| 3,688,639 | 9/1972 | Hayes | 89/45 |
| 3,811,583 | 5/1974 | Weeks | 414/676 |
| 3,822,792 | 7/1974 | Weingarten | 414/676 |
| 3,923,165 | 12/1975 | Burdick | 414/676 |
| 4,263,835 | 4/1981 | Dragonuk | 89/1.806 |
| 4,415,304 | 11/1983 | Tripoli et al. | 89/1.805 |
| 4,646,617 | 3/1987 | Robinson | 89/1.816 |
| 4,739,691 | 4/1988 | Beutler et al. | 89/1.805 |

FOREIGN PATENT DOCUMENTS

| | | | |
|---|---|---|---|
| 3413516 | 10/1985 | Fed. Rep. of Germany | 89/45 |
| 395555 | 3/1909 | France | 89/47 |

*Primary Examiner*—Deborah L. Kyle
*Assistant Examiner*—Stephen Johnson
*Attorney, Agent, or Firm*—Lloyd B. Guernsey

[57] ABSTRACT

An inflatable ammunition gripping device for handling a variety of soft and irregularly shaped ammunition without damage to the ammunition. A plurality of inflatable grippers mounted lengthwise inside a tubular transfer tube selectively press relatively large areas of the grippers to grasp ammunition for transfer between a first and a second location or to secure the ammunition in a storage location.

7 Claims, 3 Drawing Sheets

FIG_1
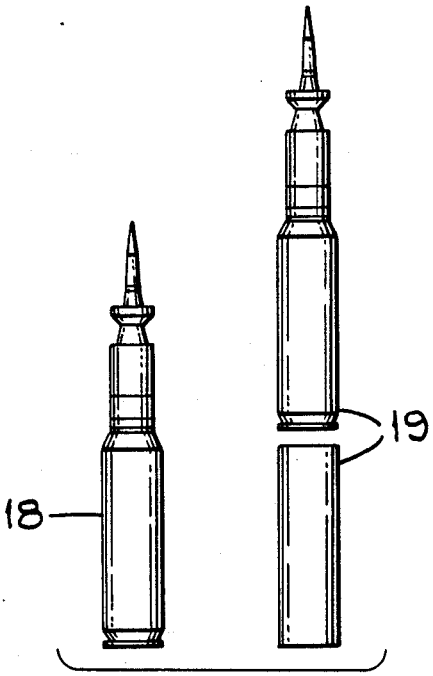
FIG_2
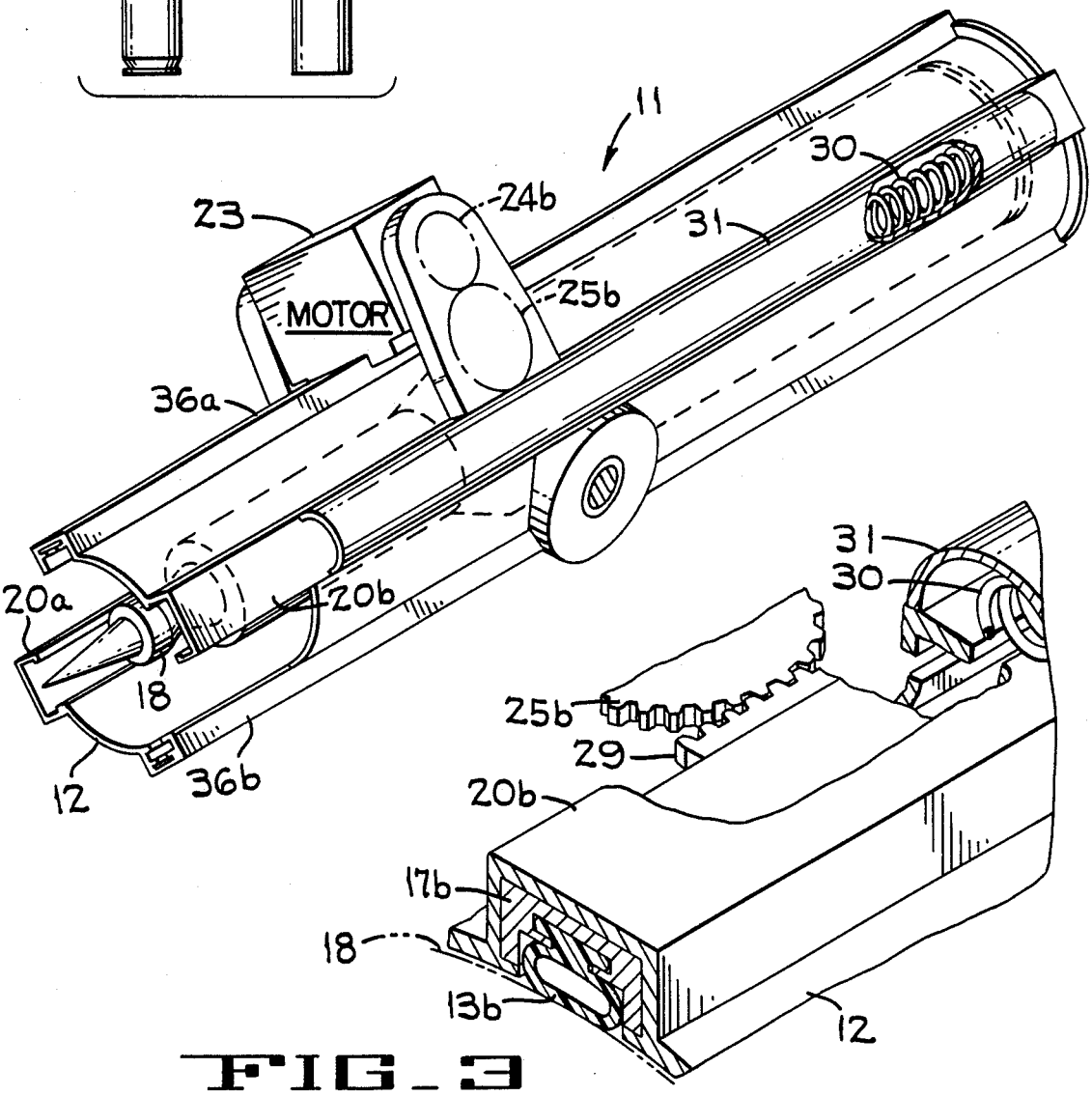
FIG_3

INFLATABLE AMMUNITION GRIPPING DEVICE

BACKGROUND OF THE INVENTION

The present invention pertains to an ammunition gripping device, and more particularly, to a gripping device for handling a variety of soft and irregularly shaped ammunition without damage to the ammunition.

Ammunition transfer mechanisms are widely used for rapidly moving ammunition from a plurality of storage areas into guns on ships, aircraft, armored land vehicles and other military equipment. Metal grippers have been used to grasp the ammunition, store it and load it into the breech of a gun. This worked quite well for the older style of metal ammunition cartridges, however, much of the present day ammunition is encased in soft shelled, irregularly shaped cases made of combustible material to reduce the problem of disposing of spent cartridges. An excess of pressure on the case by metal grippers could cause damage to the case and result in a variety of problems.

SUMMARY OF THE INVENTION

The present invention discloses an ammunition gripping device for handling a variety of soft and irregularly shaped ammunition while applying a considerable amount of force and without damaging the fragile ammunition. the present invention can also handle separated ammunition, where more than one case must be loaded into a gun breech for firing. Applicant's gripping device includes an elongated transfer tube with a plurality of inflatable elongated grippers mounted inside the transfer tube. Two or more of the grippers are movably mounted to extend lengthwise inside the transfer tube. Two or more additional grippers are fixed mounted to extend lengthwise inside the transfer tube. When the grippers are deflated the grippers are relatively flat. When the grippers are inflated they have a generally circular cylindrical shape so a large surface area of each inflated gripper presses against the ammunition inside the transfer tube. The grippers are not designed to handle any one feature of the ammunition, but can handle a variety of ammunition profiles.

When the fixed grippers are deflated and the movable grippers are inflated the movable grippers can be moved lengthwise inside the transfer tube to move the ammunition along the length of the transfer tube. when all of the grippers are inflated the ammunition is tightly secured inside the transfer tube so the transfer tube can be safely moved to transport the ammunition.

BRIEF DESCRIPTION OF THE DRAWINGS

FIG. 1 is a side elevation of some fixed ammunition and separated ammunition which can be handled by the gripping device of the present invention.

FIG. 2 shows details of a transfer tube in which the present invention can be used.

FIG. 3 is an enlarged isometric view of a portion of FIG. 2 with portions broken away to show details of the movable grippers.

DESCRIPTION OF THE PREFERRED EMBODIMENT

Figure 4:
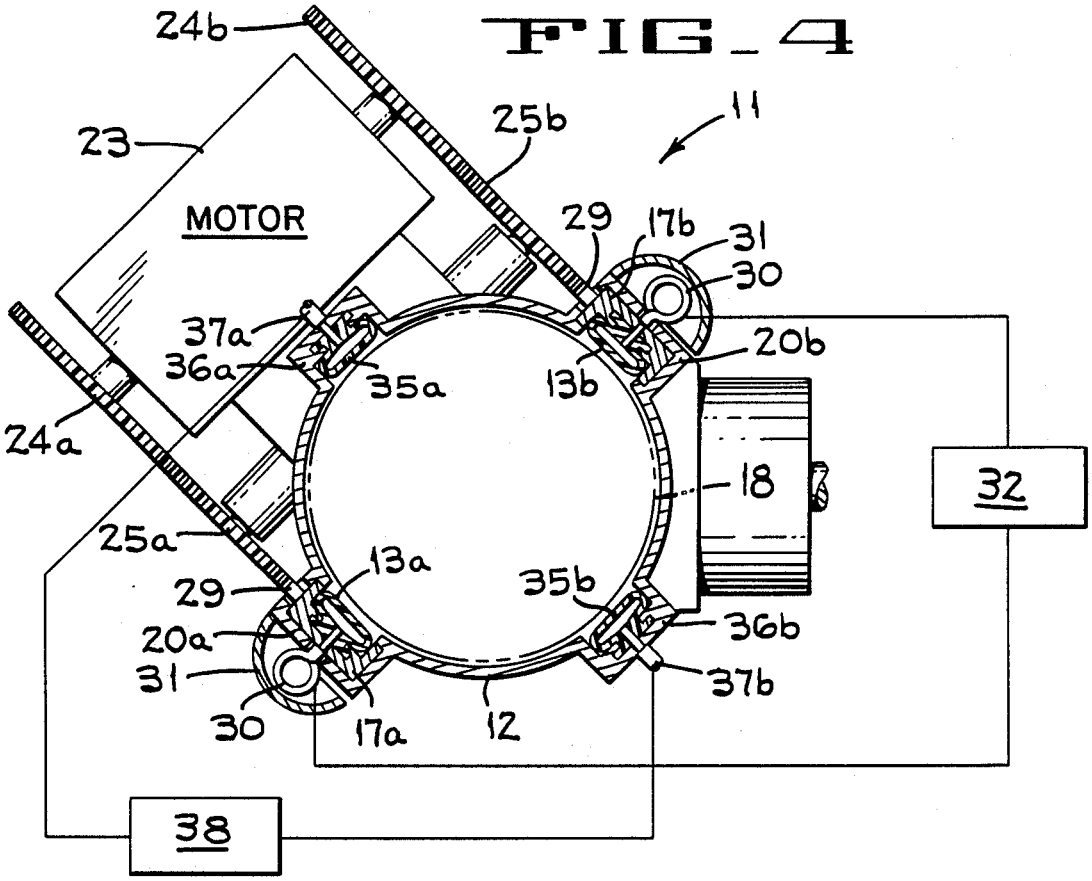
FIG. 4 is an end view of the transfer tube of FIG. 2 showing details of the inflatable grippers.

An ammunition gripping device 11 (FIGS. 2–4 of the present invention includes an elongated transfer tube 12 having a pair of inflatable elongated shuttle grippers 13*a*, 13*b* each movably connected to tube 12 by a shuttle rail 17*a*, 17*b*. Shuttle grippers 13*a*, 13*b* can handle a variety of different types of ammunition, such as a single fixed type 18 (FIG. 1) or a separated type of ammunition 19. Shuttle rails 17*a*, 17*b* are each slidably mounted in a guide 20*a*, 20*b* as shown in FIG. 3 to facilitate gripping and moving the ammunition. A shuttle motor 23 (FIGS. 2, 4) and a plurality of gears 24*a*, 24*b*, 25*a*, 25*b* are coupled to a rack 29 on each shuttle rail 17*a*, 17*b* to move shuttle grippers 13*a*, 13*b* along the length of transfer tube 12. A length of coiled tubing 30 (FIGS. 2, 4, 8–12) connected between a first source of pressure 32 (FIG. 4) and shuttle grippers 13*a*, 13*b* provide a means for inflating the grippers. The tubing 30 is encased in a protective shield 31 (FIGS. 2–4). A pair of fixed mounted grippers 35*a*, 35*b* (FIG. 4) are mounted inside a pair of channels 36*a*, 36*b* extending lengthwise along transfer tube 12 with fixed grippers equally spaced from shuttle grippers 13*a*, 13*b*. A pair of tubing 37*a*, 37*b* (FIG. 4) couples a second source of pressure 38 to the fixed grippers 35*a*, 35*b*.

Figure 5:
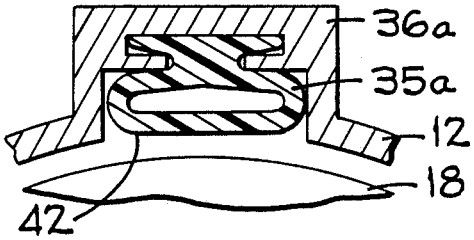
FIG. 5 is an end view of a gripper in a deflated position.
Figure 6:
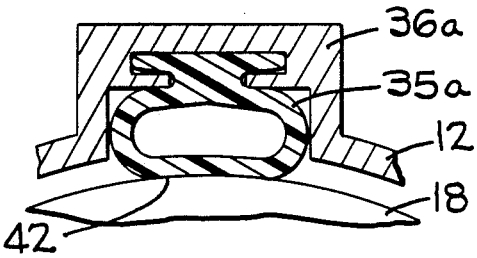
FIG. 6 is an end view of a gripper in an inflated position.
Figure 7:
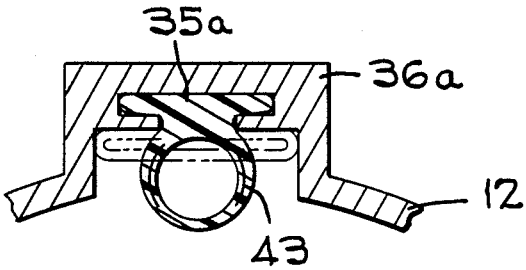
FIG. 7 is an end view of a gripper having a spring molded inside to increase the speed of change from an inflated position to a deflated position.

When grippers 13*a*, 13*b*, 35*a*, 35*b* are in a deflated condition they are each as shown in FIG. 5 where a surface 42 is spaced from ammunition 18. When the grippers are inflated surface 42 presses against ammunition 18 to hold the ammunition securely without exerting enough pressure to cause damage to the ammunition as shown in FIG. 6. Surface 42 has a relatively large area making contact with ammunition 18 so a large total amount of holding force can be applied to ammunition 18 but with a relatively small amount of force per square inch. If no ammunition is adjacent to gripper 35*a* it expands into a generally cylindrical form as shown in FIG. 7. To increase the speed with which gripper 35*a* returns to a flat deflated position when pressure is released, a spring 43 can be molded in the gripper 35*a* as shown in FIG. 7.

Figures 8, 9, 10, 11, 12:
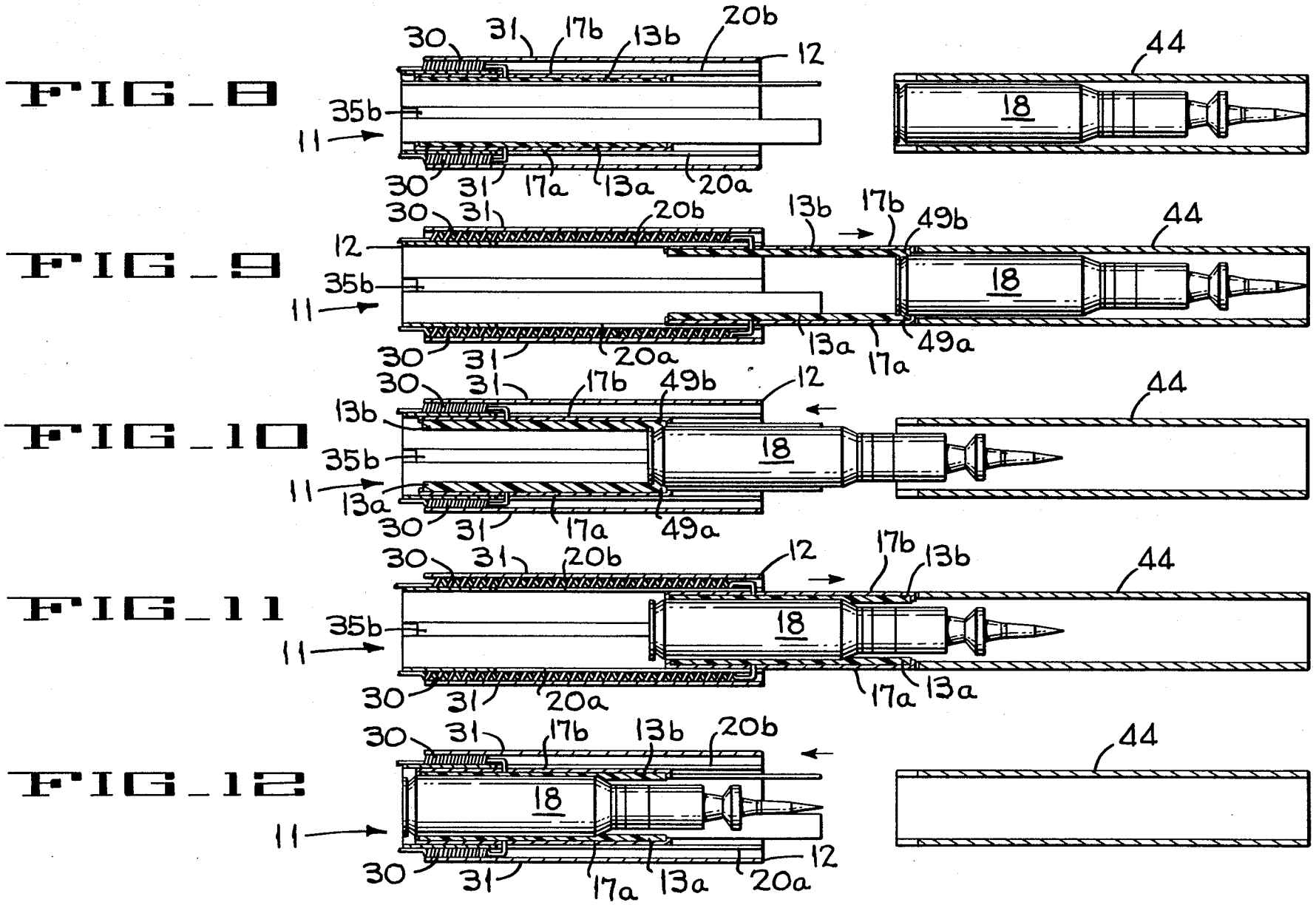
FIGS. 8–12 show a sequence of operation of the transfer tube and grippers moving ammunition from a storage area into the transfer tube.

A sequence of operation for moving ammunition 18 from transfer tube 12 to a magazine 44, is shown in FIGS. 8–12. Ammunition gripping device 11 is positioned adjacent to magazine 44 with shuttle grippers 13*a*, 13*b* inside transfer tube 12 in a deflated condition as shown in FIG. 8. Shuttle grippers 13*a*, 13*b* (FIGS. 4, 9) are moved by motor 23 and shuttle rails 17*a*, 17*b* so a right end portion 49*a*, 49*b* grasps a portion of ammunition 18 when shuttle grippers 13*a*, 13*b* are inflated. Shuttle grippers 13*a*, 13*b* are then moved toward the left (FIG. 10) to pull ammunition 18 approximately half way into transfer tube 12. Fixed grippers 35*a*, 35*b* (FIG. 4) are inflated to hold ammunition securely while shuttle grippers 13*a*, 13*b* are deflated and moved to the right into the position shown in FIG. 11. Shuttle grippers 13*a*, 13*b* are again inflated, fixed grippers 35*a*, 35*b* (FIG. 4) are deflated and shuttle grippers 13*a*, 13*b* moved toward the left (FIG. 12) to pull ammunition 18 fully into transfer tube 12. Fixed grippers 35*a*, 35*b* are again inflated so all of the grippers 13*a*, 13*b*, 35*a*, 35*b* hold ammunition 18 securely as gripping device 11 moves ammunition 18 to the desired location.

The sequence of moving ammunition 18 from transfer tube 12 into the magazine 44 is the reverse of the sequence of moving from magazine 44 to transfer tube 12. Ammunition 18 is moved from the position inside transfer tube 12 (FIG. 12) to a position partially inside the magazine 44 (FIG. 4) similar to FIG. 11. Grippers 13*a*, 13*b* are moved to regrip ammunition 18 as in FIG. 10, and the ammunition 18 is moved into the position fully inside magazine 44 (FIG. 9).

The present invention provides a gripping device having a plurality of inflatable grippers mounted lengthwise inside a tubular ammunition transfer tube. Relatively large surface areas on the grippers provide a relatively large holding force for a variety of shapes of soft ammunition while providing a relatively low value of pressure per square inch. Thus, soft ammunition can be handled firmly without damage to the ammunition.

Although the best mode contemplated for carrying out the present invention has been herein shown and described, it will be apparent that modification and variation may be made without departing from what is regarded to be the subject matter of the invention.

What is claimed is:

1. An ammunition gripping device for handling a variety of soft and irregularly shaped ammunition while applying a considerable amount of force without damage to the ammunition, said gripping device being adapted for use with a pair of sources of pressure, said gripping device comprising:

an elongated transfer tube;

a plurality of inflatable elongated grippers;

means for movably mounting said elongated grippers inside said transfer tube with said elongated grippers extending lengthwise of said transfer tube and with said elongated grippers spaced apart in said transfer tube;

means for connecting said elongated grippers to a first source of pressure to selectively inflate said elongated grippers to grip ammunition inside said transfer tube;

a plurality of inflatable fixed grippers mounted lengthwise inside said transfer tube with said fixed grippers spaced between said elongated grippers and with said fixed grippers being fixed to said transfer tube;

means for connecting said fixed grippers to a second source of pressure to selectively inflate said fixed grippers to grip ammunition inside said transfer tube; and means for selectively moving said elongated grippers along a length of the said transfer tube to selectively move said ammunition along the length of said transfer tube.

2. An ammunition gripping device as define in claim 1 wherein each of said inflatable elongated grippers and each of said inflatable fixed grippers includes a relatively large surface area to provide a high gripping force on said ammunition while imparting a low contact force on said ammunition.

3. An ammunition gripping device as defined in claim 1 wherein each of said inflatable elongated grippers and each of said inflatable fixed grippers includes a relatively flat deflated tube, said tube assuming a generally circular cylindrical shape when fully inflated without grasping any ammunition.

4. An ammunition gripping device as defined in claim 1 wherein each of said inflatable elongated grippers and each of said inflatable fixed grippers includes a hollow elastomeric tube having a relatively flat shape when deflated and having a generally circular cylindrical shape when fully inflated.

5. An ammunition gripping device as defined in claim 1 wherein said elongated grippers extend along the length of said transfer tube to engage a plurality of separated sections of said ammunition to simultaneously move said separated sections of said ammunition.

6. An ammunition gripping device as defined in claim 1 wherein each of said inflatable elongated grippers and each of said inflatable fixed grippers includes a relatively large surface area to facilitate handling fragile ammunition.

7. An ammunition gripping device as defined in claim 1 wherein each of said inflatable elongated grippers and each of said inflatable fixed grippers is expandable to securely contact a plurality of different shapes of ammunition to selectively move said ammunition.

* * * * *